US008104121B2

(12) United States Patent
Bourgraf et al.

(10) Patent No.: US 8,104,121 B2
(45) Date of Patent: Jan. 31, 2012

(54) COMBINATION AMBULANCE COT AND CHAIR

(75) Inventors: Elroy Edwin Bourgraf, Naples, FL (US); Irvin Pollock, Wilmington, OH (US)

(73) Assignee: Ferno-Washington, Inc., Wilmington, OH (US)

( * ) Notice: Subject to any disclaimer, the term of this patent is extended or adjusted under 35 U.S.C. 154(b) by 4 days.

(21) Appl. No.: 11/344,878

(22) Filed: Feb. 1, 2006

(65) Prior Publication Data

US 2007/0174967 A1 Aug. 2, 2007

(51) Int. Cl.
*A61G 1/02* (2006.01)

(52) U.S. Cl. ..... 5/618; 5/613; 5/617

(58) Field of Classification Search ..... 5/618, 613, 5/86.1, 617, 657, 81.1 R; 292/173; 280/304.15, 280/304.5

See application file for complete search history.

(56) References Cited

U.S. PATENT DOCUMENTS

| | | | | |
|---|---|---|---|---|
| 1,709,137 | A | 4/1929 | Loxley | |
| 2,690,208 | A | 9/1954 | Mary | |
| 2,699,557 | A | 1/1955 | Gravatt | |
| 3,122,758 | A | 3/1964 | Ferneau | |
| 3,137,511 | A | 6/1964 | Weil et al. | |
| 3,289,219 | A | 12/1966 | Ferneau et al. | |
| 3,380,085 | A | 4/1968 | Ferneau et al. | |
| 4,105,242 | A | 8/1978 | Terbeek | |
| 4,155,126 | A | 5/1979 | Classen | |
| 4,688,279 | A | 8/1987 | Vance | |
| 4,795,214 | A | 1/1989 | Holdt | |
| 4,949,410 | A | 8/1990 | Failor et al. | |
| 4,974,905 | A | 12/1990 | Davis | |
| 5,327,798 | A * | 7/1994 | Lerch, Jr. | 74/551.3 |
| 5,509,159 | A * | 4/1996 | Du-Bois | 5/627 |
| 6,257,609 | B1 | 7/2001 | O'Neill, Sr. | |
| 6,381,781 | B1 * | 5/2002 | Bourgraf et al. | 5/618 |
| 6,792,633 | B1 | 9/2004 | Ito | |
| 6,893,386 | B2 | 5/2005 | Charoenchit | |

FOREIGN PATENT DOCUMENTS

| | | | |
|---|---|---|---|
| AU | 27756 77 | A | 2/1979 |
| CH | 552983 | A | 8/1974 |
| DE | 37 30 669 | A1 | 9/1987 |
| GB | 26420 | | 2/1912 |
| GB | 1 416 698 | | 12/1975 |
| GB | 2358793 | A | 8/2001 |
| JP | 4118048 | Y1 | 8/1966 |
| JP | 6287553 | U | 6/1987 |
| JP | 09322912 | | 12/1997 |

(Continued)

OTHER PUBLICATIONS

European Examination Report dated Jul. 23, 2009 pertaining to European Application No. 07 763 053.1.

European Examination Report dated Feb. 18, 2010 pertaining to European Application No. 07 763 053.1.

International Search Report and Written Opinion dated Jul. 12, 2007 pertaining to International application No. PCT/US2007/002617.

(Continued)

*Primary Examiner* — Michael Trettel
*Assistant Examiner* — William Kelleher
(74) *Attorney, Agent, or Firm* — Dinsmore & Shohl LLP

(57) ABSTRACT

A combination ambulance cot and chair is disclosed. The invention includes a support frame, and a segmented patient support pivotally mounted to the support frame for movement at least between a chair position and a fully-reclined position. The segmented patient support has a seat segment. A securing device is connected functionally to the support frame and the seat segment, and configured to releasably secure the combination ambulance cot and chair in at least the fully-reclined position.

20 Claims, 4 Drawing Sheets

FOREIGN PATENT DOCUMENTS

| | | | |
|---|---|---|---|
| JP | 10052459 | | 2/1998 |
| JP | 2001178778 | A | 7/2001 |
| JP | 2001190599 | A | 7/2001 |
| JP | 2002078746 | | 3/2002 |
| JP | 2004329467 | A | 11/2004 |
| JP | 2005013637 | A | 1/2005 |
| JP | 2005021628 | A | 1/2005 |
| WO | WO 9834575 | A2 | 8/1998 |
| WO | 0051542 | A1 | 9/2000 |
| WO | WO 0113854 | A1 | 3/2001 |

OTHER PUBLICATIONS

International Preliminary Report on Patentability dated Aug. 14, 2008 pertaining to International application No. PCT/US2007/002617.

Chinese Office Action dated May 20, 2010, pertaining to Chinese Application No. 200780007872.9.

Japanese Office Action dated Jul. 27, 2011 pertaining to Application No. 2008-553322.

* cited by examiner

COMBINATION AMBULANCE COT AND CHAIR

BACKGROUND OF THE INVENTION

The present invention relates to a combination ambulance cot and chair used to load patients into the back of an ambulance.

In transporting emergency patients from their homes to a hospital for treatment, it is oftentimes necessary to remove the patient from his home using an ambulance cot, such as a stretcher, or the like, wherein the patient is situated thereon in a generally supine position. As well known in the art, such cots are typically provided with an undercarriage having a rollable base which facilitates transportation of the patient situated upon the cot to an ambulance parked near the patient's home. The undercarriage may be collapsed, thereby permitting the cot, its undercarriage, and the patient situated thereon to be rolled into the back of the ambulance in a fully-reclined position for transportation to the hospital.

However, in removing the patient from his home, it is sometimes difficult for paramedics to reach the patient with a fully-reclined cot, such as those of the prior art. Particularly, it is difficult for paramedics to traverse stairs to/from a second floor of the patient's home with a fully-reclined cot, or where the patient's home includes narrow hallways and doorways, through which maneuvering of a fully-reclined cot is extremely difficult, and sometime, impossible. In such situations, it is desirable for the cot to have a reduced "footprint," such as that provided by a wheelchair or the like, to facilitate maneuvering of the cot and of a patient situated thereon through the patient's home. Once the cot has been removed to a location free from any obstructions of the patient's home, such as, to a location near the back of the ambulance, it is desirable for the cot to be fully-reclining to facilitate rolling the cot into the back of an ambulance.

Accordingly, there is a continued need to provide a combination ambulance cot and chair which is movable between a fully-reclined position, where a patient situated thereon is resting in a generally supine position, and a chair position, where a patient situated thereon is in a generally upright, sitting position. In addition, it has been observed that prior art combination ambulance cot and chairs do not easily transition from the chair position to the fully-reclined position. Due to the typically provided ratcheting mechanism on such prior art cots, paramedics must pull up and then lower the cot into its reclined position. This lowering operation with these prior art cots is jarring which can add further discomfort to the patient. Accordingly, there is also a need to provide a combination ambulance cot and chair which transitions smoothly between the chair position and the fully-reclined position.

SUMMARY OF THE INVENTION

It is against the above back ground that the present invention provides a combination ambulance cot and chair used to load a patient into the back of an ambulance. The cot of the present invention is movable between a fully-reclined position, wherein a patient situated thereon is in a generally supine position, and a chair position, wherein the patient situated thereon is generally upright in a seated position thereby providing a cot with a reduced footprint.

Additionally, the cot of the present invention includes folding legs pivotally mounting a support frame to a wheeled base. A segmented patient support is adjustably connected to the support frame and includes a back segment, a leg segment, and seat segment. The back segment is pivotably connected at one end thereof to the support frame, and is inclinable to a plurality of positions. The seat segment is pivotably connected to the support frame at both ends. The leg segment is pivotably connected to the seat segment and the support frame. Accordingly, with the patient support segments interconnected as such, the seat and leg segments move in unison with the cot support frame from the chair position to the fully-reclined position.

In one embodiment, a combination ambulance cot and chair is disclosed. The combination ambulance cot and chair comprises a support frame, and a segmented patient support pivotally mounted to the support frame for movement at least between a chair position and a fully-reclined position. The segmented patient support has a seat segment. A securing device is connected functionally to the support frame and the seat segment, and is configured to releasably secure the combination ambulance cot and chair in at least the fully-reclined position.

In another embodiment, a combination ambulance cot and chair comprising a support frame, and a segmented patient support pivotally mounted to the support frame for movement at least between a chair position and a fully-reclined position is disclosed. The segmented patient support has a seat segment and a leg segment pivotably attached to the seat segment. A securing device has a pivot member fixed to the seat segment, the pivot member being releasably locatable in at least the fully-reclined position. A wheeled base and legs, each having a first end pivotably attached to the support frame and a second end attached to the wheeled base, are also provided. The combination cot and chair is selectively positionable in either a raised position which situates the legs substantially perpendicular to the seat segment, and a lowered position which situates at least two of the legs folded adjacent the seat segment.

In another embodiment, a combination ambulance cot and chair comprising a support frame, and a segmented patient support pivotally mounted to the support frame for movement at least between a chair position and a fully-reclined position is disclosed. The segmented patient support has a seat segment, a leg segment pivotably attached to the seat segment, and a back segment pivotably attached to the support frame. A securing device having a pin and a pivot member providing a plurality of pin catches each sized to accommodate at least a portion of the pin is also provided. The seat segment is fixed to the pivot member, and the pin is movably between the catches, whereby when the pin is accommodated in a first one of the pin catches, the combination ambulance cot and chair is releasably secured in the fully-reclined position, and when the pin is accommodated in a second one of the pin catches, the combination ambulance cot and chair is releasably secured in the chair position. A wheeled base and legs, each having a first end pivotably attached to the support frame and a second end attached to the wheeled base, are provided. The combination cot and chair is selectively positionable in either a raised position which situates the legs substantially perpendicular to the seat segment, and a lowered position which situates at least two of the legs folded adjacent the seat segment.

These and additional objects, features and advantages of the present invention will become apparent to those reasonably skilled in the art from the description which follows, and may be realized by means of the instrumentalities and combinations particularly pointed out in the claims appended hereto.

BRIEF DESCRIPTION OF THE DRAWINGS

A better understanding of the present invention will be had upon reference to the following description in conjunction with the accompanying drawings in which like reference numerals represent like parts, and wherein.

DETAILED DESCRIPTION OF THE INVENTION

Figure 1:
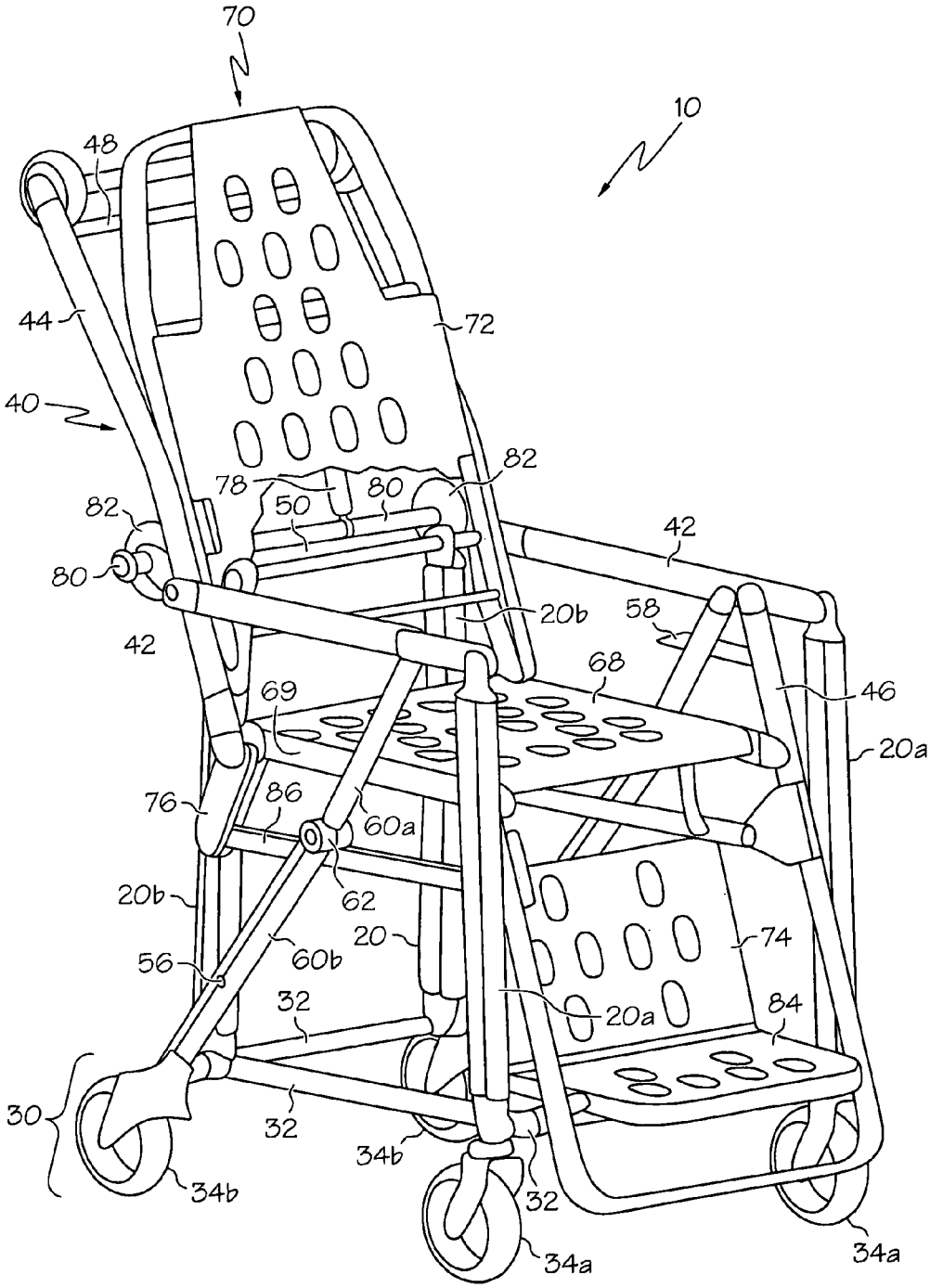
FIG. 1 is a front side perspective view of a combination ambulance cot and chair according to an embodiment of the present invention, showing the cot in a chair position, and with some parts sectioned away for ease of illustration.

With reference to FIGS. 1-4, according to an embodiment of the present invention a combination ambulance cot and chair 10 is shown. The combination ambulance cot and chair 10 (herein referred to as cot 10) includes legs 20 supportably connecting a wheeled base, generally indicated as symbol 30 to a support frame, generally indicated as symbol 40. Wheeled base 30 includes a generally rectangular frame having members 32, connected in an end-to-end fashion, and wheels 34 attached to respective frame members 32 at their ends of intersection. In the illustrated embodiment, the front wheels 34*a* are swivel castors to facilitate steering and maneuvering of cot 10, whereas the rear wheels 34*b* are fixedly mounted to the respective frame members 32.

The support frame 40 is generally rectangular in shape and comprises a pair of side arm members 42, a pair of upper frame members 44, a lower frame members 46, and upper and lower crossbars 48 and 50, which are best seen in FIG. 1. Each side arm member 42 is pivotably attached at one end to a respective one of the upper frame members 44 and to the lower frame member 46 adjacent the other end. At the ends remote from the ends attached to the upper frame members 44, the side arm members 42 are pivotably attached to a first pair of the legs 20*a*. A second par of the legs 20*b* are pivotably attached to the lower crossbar 50. Upper crossbar 48 is fixedly secured between the pair of upper frame members 44. Accordingly, legs 20*a*, 20*b* are pivotally mounted to the support frame 40 and the wheeled base 30 such that the legs may swing the wheeled base generally parallel to the support frame.

Figure 3:
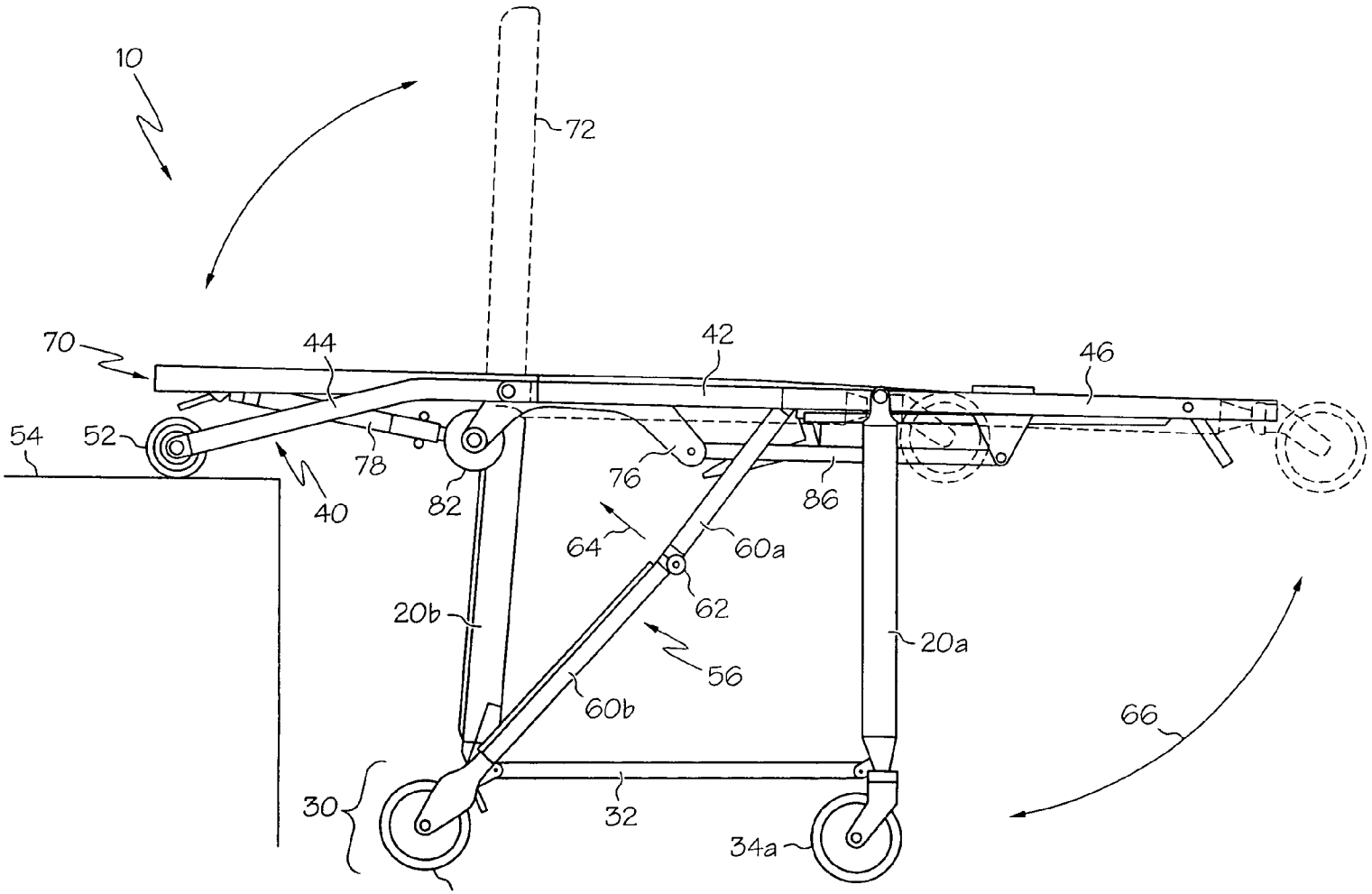
FIG. 3 is a side view of the combination ambulance cot and chair of FIG. 1, showing the cot in a fully-reclined raised position, with the legs and wheeled base also shown in dashed lines to indicated the combination ambulance cot and chair being positionable in a lowered position.

A pair of loading wheels 52 are rotatably mounted to ends of the upper frame members 44. As best seen in FIG. 3, each upper frame member 44 is slightly bent such that the loading wheels 52 are below the side arm members 42 when the cot is place in the fully-reclined raised position. This is to help facilitate loading of the cot chair onto a support surface 54, such as provided by a transport bay of an emergency vehicle.

Figure 2:
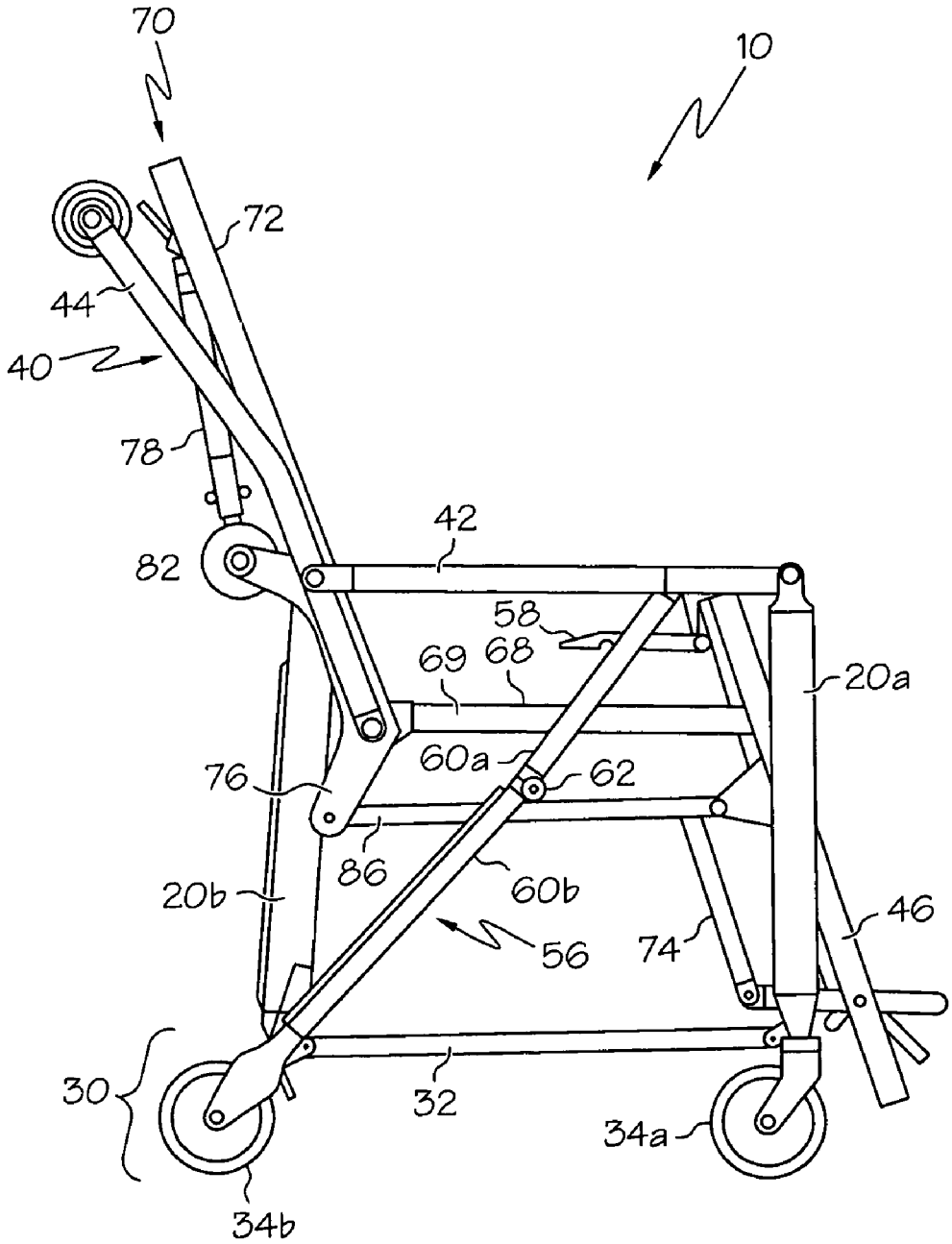
FIG. 2 is a side view of the combination ambulance cot and chair of FIG. 1.

A pair of braces, generally indicated by symbol 56, is pivotally mounted diagonally to the support frame 40 and the wheeled base 30. In the raised position of the cot 10, illustrated by FIGS. 1-3, the pair of braces 56 releasably secures the legs 20*a*, 20*b* perpendicularly to the side arm members 42 via a releasably catch 58. In the raised position, the support frame 40 is positionable in either a chair position such as illustrated by FIGS. 1 and 2, or a fully-reclined position which is illustrated by FIG. 3.

Each of the braces 56 have upper and lower links 60*a* and 60*b*, respectively, connected by an over-center hinge 62. Since each lower link 60*b* is pivotally mounted to the wheeled base 30 and each upper link 60*a* is pivotally mounted to the support frame 40, breaking the over-center hinge 62 in the direction of the arrow 64 will permit the wheel base 30 to swing relative to the support frame 40 in the direction of arrow 66, thereby placing the cot 10 in a lowered position, which is illustrated by the dashed lines in FIG. 3. In the lowered position, the second pair of legs 20*b* are folded adjacent side arm members 42 below a seat segment 68 of a segmented patient support.

Cot 10 further includes the segmented patient support, generally indicated by 70, which is also adjustable between the chair position, such as shown in FIG. 1, and the fully-reclined position, such as shown in FIG. 3. The segmented patient support 70 comprises three main segments namely, a back segment 72, the seat segment 68, and a leg segment 74. The back segment 72 is generally u-shaped and is pivotably connected at a lower end between a pair of brackets 76. The back segment 72 is also mounted at an upper end to a lift cylinder 78 and thus may be releaseably positioned in a plurality of locations between a fully-reclined position as shown in FIG. 3, and an upright position which is indicated by the dashed line. The other end of the lift cylinder 78 is rotatably attached to a cross member 80. The cross member 80 is mounted also between the pair of brackets 76, and mount a second pair of loading wheels 82, which is best seen by FIG. 1.

A footrest 84 is pivotably attached adjacent a distal end between the lower frame member 46 and at a proximate end to the leg segment 74. The leg segment 74 is further pivotably attached to the seat segment 68 adjacent a distal end thereof. The seat segment 68 includes side supports 69. The distal end of the side support 69 of the seat segment 68 is pivotably attached between the lower frame member 46. A proximate end of the side support 69 of the seat segment 68 is pivotably attached between the pair of brackets 76.

In addition to the pair of brackets 76, a pair of linkages 86 is further provided to the support frame 40. Each of the linkages 86 is rotatably attached to the lower frame member 46 at a first end and to a respective one of the brackets 76 at a second end. Each bracket 76 is mounted to a respective one of said upper frame members 44. In this manner, as the upper frame members 44 are transitioned from the chair position shown in FIG. 1, to the fully-reclined position shown in FIG. 3, the brackets 76 will push the linkages 86, lifting the lower frame member 46, and the seat segments 68, leg segments 74, and footrest 84 connected thereto, into the fully-reclined position.

Figure 4:
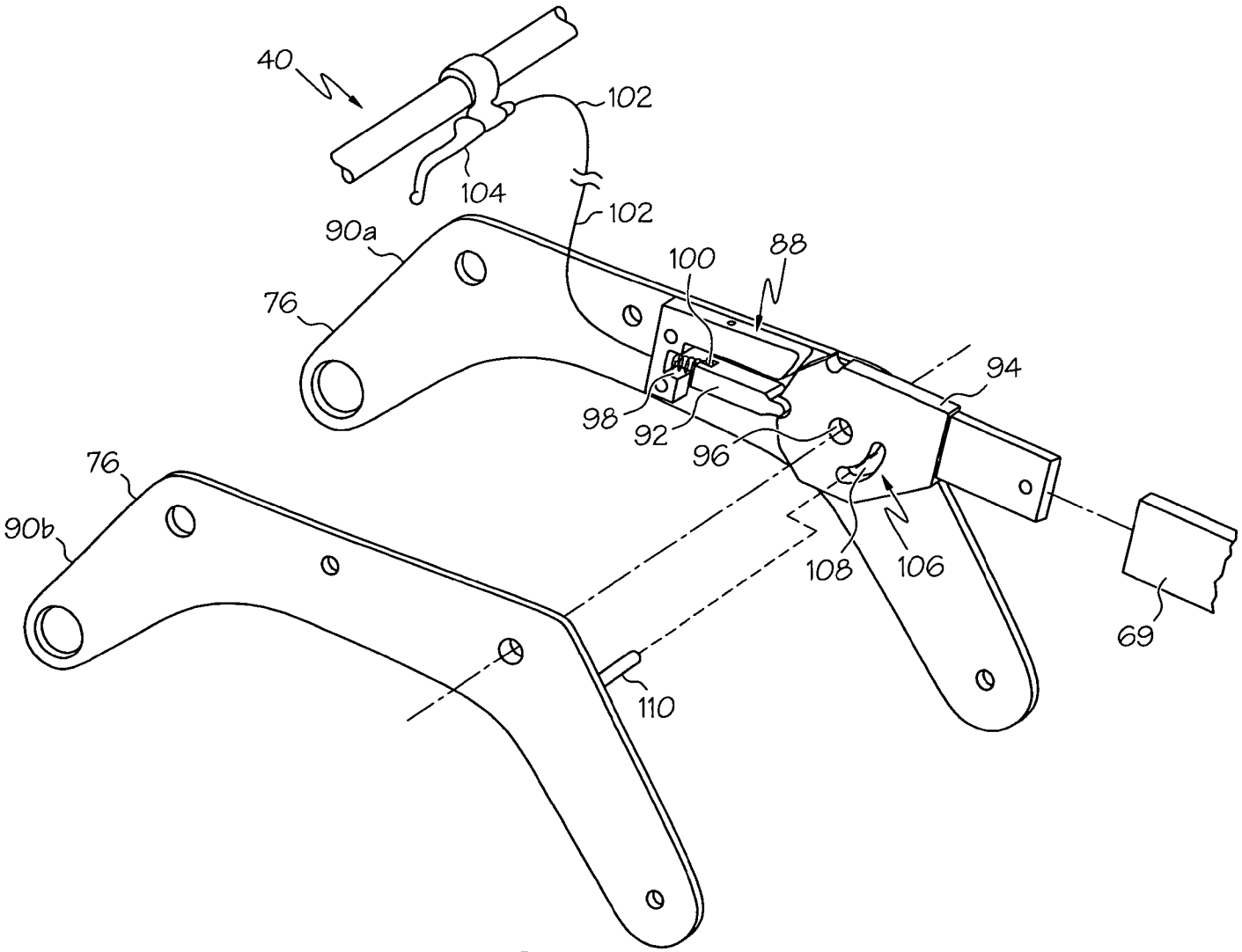
FIG. 4 is a perspective view of a bracket and a securing device of the combination ambulance cot and chair of FIG. 1 according to the present invention.

A securing device is connected functionally to the support frame 40 and the seat segment 68, and configured to releasably secure the cot 10 in at least the fully-reclined position. FIG. 4 shows one of the brackets 76, which provides in one embodiment the securing device, generally indicated by symbol 88, between first and second bracket members 90*a*, 90*b*. The same type of securing device 88 may also be provided to both brackets 76 in another embodiment.

The securing device 88 includes a locking member 92 which releasably engages a keeper 96. In the illustrated embodiment the locking member 92 is a pin, but in other embodiments may be for example, a dog, a pawl, a level, a claw, a hook, etc., and the keeper 96 is a plurality of pin catches, but in other embodiments may be for example, ratchets, notches, recesses, holes, a cam, etc. Additionally, in the illustrated embodiment the locking member is provided to bracket member 90*a*, and the keeper 96 is provided to a pivot member 94, but in other embodiments relative positions may be reversed, so long as the relative motion between the bracket members 90*a*, 90*b* and their associated pivot members 94 can be releaseably arrested by the securing device 88. Accordingly, any securing device which accomplishes the above mentioned arresting function may be used with the present invention.

At one end, the side support 69 of the seat segment 68 is fixed to the pivot member 94. In the illustrated embodiment, the keepers 96 are each sized to accommodate at least a portion of the locking member 92, in which the locking member is spring biased via spring 98 to remain situated in one of the keepers 96. A guide block 100 houses the locking member 92 and spring 98 between the bracket members 90*a* and 90*b*. The locking member 92 is attached to a pull cable 102 such that a hand actuator 104 may clear the locking member 92 of the keepers 96.

Once the locking member 92 is cleared of the keepers 96, the support frame 40 may be transitioned to either the fully-reclined position or the chair position. Accordingly, it is to be appreciated that when the locking member 92 is accommodated in a first one of the keepers 96, the support frame, and hence cot 10, is releasably secured in the fully-reclined position, and when the locking member 92 is accommodated in a second one of the keepers 96, the support frame 40, and hence cot 10, is releasably secured in the chair position.

As also shown by FIG. 4, the securing device 88 and the support frame 40 provide a pin guide-fixed pin arrangement, generally indicated by symbol 106. The pin guide-fixed pin arrangement 88 includes a pin guide or track 108 that is located about a portion of a diameter of a fixed pin 110. In the illustrated embodiment, the fixed pin 110 is provided situated between the bracket members 90*a*, 90*b*, and slidably housed in the pin guide 108. The pin guide 108 as illustrated, is provided to the pivot member 94, which is rotatably attached between the bracket members 90*a*, 90*b*.

Although the present invention has been described in terms of a specific embodiment which is set forth in detail, it should be understood that this is by illustration only and that the present invention is not necessarily limited thereto, since alternative embodiments not described in detail herein will become apparent to those skilled in the art in view of the above description, the attached drawings and the appended claims. Accordingly, modifications are contemplated which can be made without departing from either the spirit or the scope of the present invention.

What is claimed is:

1. A combination ambulance cot and chair, comprising:

a support frame comprising a pair of upper frame members, a lower frame member, and a pair of side arm members pivotally connected at one end to the upper frame member and to the lower frame member adjacent to the other end, said support frame having a pair of brackets and a pair of linkages, each of said pair of brackets comprising at least one one-piece member, said pair of brackets mounted to said pair of upper frame members;

a segmented patient support pivotally mounted to said support frame for movement at least between a chair position and a fully-reclined position, said segmented patient support has a seat segment and a back segment, said seat segment having a side support; and a securing device connected functionally to said support frame and a proximate end of said side support of said seat segment, and configured to releasably secure said combination ambulance cot and chair in at least the fully-reclined position by a remote actuator, wherein said securing device is provided to one of said pair of brackets, wherein said securing device and support frame provide a pin guide-fixed pin arrangement, and wherein said pair of side arm members are pivotally connected to said pair of brackets at a first position on said one-piece member, and wherein a proximate end of said side support of said seat segment is pivotally connected to said pair of brackets at a second position on said one-piece member, and wherein a proximate end of said pair of linkages is pivotally connected to said pair of brackets at a third position on said one-piece member and a distal end of said pair of linkages is pivotally connected to said lower frame member, and wherein said upper frame members are pivotally connected to said pair of brackets at said first position and said second position, and wherein said second position is intermediate said first position and said third position, wherein said back segment is pivotably attached to said support frame, and wherein when said pair of upper frame members are moved from a chair position to a reclined position, said pair of brackets push said pair of linkages lifting said lower frame member.

2. A combination ambulance cot and chair as claimed in claim 1, wherein said securing device is spring biased and configured to releasably secure said combination ambulance cot and chair additionally in the chair position.

3. A combination ambulance cot and chair as claimed in claim 1, wherein said securing device provides a locking member and a pivot member having a keeper sized to accommodate at least a portion of said locking member, wherein said seat segment is fixed to said pivot member, whereby when said locking member is accommodated in said keeper, said combination ambulance cot and chair is releasably secured in the fully-reclined position.

4. A combination ambulance cot and chair as claimed in claim 1, wherein said securing device provides a pin and a pivot member having a plurality of pin catches each sized to accommodate at least a portion of said pin, wherein said seat segment is fixed to said pivot member, whereby when said pin is accommodated in a first one of said pin catches, said combination ambulance cot and chair is releasably secured in the fully-reclined position, and when accommodated in a second one of said pin catches, said combination ambulance cot and chair is releasably secured in the chair position.

5. A combination ambulance cot and chair as claimed in claim 1, wherein said securing device provides a spring biased pin and pivot member having a plurality of pin catches each sized to accommodate at least a portion of said spring biased pin, said pivot member also includes said pin guide located about a portion of a diameter of a fixed pin of the support frame, and wherein said seat segment is fixed to said pivot member, whereby when said pin is accommodated in a first one of said pin catches, said combination ambulance cot and chair is releasably secured in the fully-reclined position, and when accommodated in a second one of said pin catches, said combination ambulance cot and chair is releasably secured in the chair position.

6. A combination ambulance cot and chair as claimed in claim 1, and said securing device has a pivot member which is fixed to said seat segment.

7. A combination ambulance cot and chair as claimed in claim 1, wherein said pair of brackets mounting a cross-member therebetween at said first position, said support frame further comprising a first pair of legs each pivotably attached to a respective one of said side arm members, and a second pair of legs pivotably attached to said cross-member.

8. A combination ambulance cot and chair as claimed in claim 1, wherein said pair of brackets mounting a cross-member therebetween at said first position, said support frame further comprising a first pair of legs each pivotably attached to a respective one of said side arm members at a location spaced from said pair of brackets, and a second pair of legs pivotably attached to said cross-member, and wherein said securing device has a pivot member which is fixed to said seat segment.

9. A combination ambulance cot and chair as claimed in claim 1, further comprising a wheeled base, said pair of brackets mounting a cross-member therebetween at said first position, said support frame further comprising a first pair of legs each pivotably attached at a first end to a respective one of said side arm members and at a second end to the wheeled base, and a second pair of legs pivotably attached at a first end to said cross-member and at a second end to the wheeled base, and wherein said securing device has a pivot member which is fixed to said seat segment.

10. A combination ambulance cot and chair as claimed in claim 1, wherein said combination ambulance cot and chair further comprises a wheeled base; and legs each having a first end pivotably attached to said support frame and a second end attached to said wheeled base, wherein said combination cot and chair is selectively positionable in either a raised position wherein said legs are substantially perpendicular to said seat segment, and a lowered position wherein at least two of said legs fold under said seat segment.

11. A combination ambulance cot and chair as claimed in claim 1, wherein said support frame further includes a cross member mounted between said pair of brackets at said first position, and said combination ambulance cot and chair further comprises a wheeled base; and first and second pairs of legs, said first pair of legs are each pivotally attached to a respective one of said side arm members and said wheeled base, said second pair of legs pivotally mounted to said cross-member and said wheeled base, wherein said combination cot and chair is selectively positionable in either a raised position wherein said legs are substantially perpendicular to said pair of side arm members, and a lowered position wherein said second pair of legs fold under said seat segment; and at least one diagonal brace pivotally mounted to one of said side arm members and said wheeled base to releasably secure said combination ambulance cot and chair in said raised position.

12. A combination ambulance cot and chair as claimed in claim 1, wherein said segmented patient support further comprises a leg segment pivotably attached to said seat segment.

13. A combination ambulance cot and chair as claimed in claim 1, wherein said segmented patient support further comprises a leg segment, wherein said seat segment and said leg segment are pivotably attached, and wherein said back segment further includes a biasing spring for raising said back segment from a first substantially horizontal position to a plurality of raised positions.

14. A combination ambulance cot and chair as claimed in claim 1, wherein said segmented patient support further comprises a leg segment pivotably attached to said seat segment, wherein said leg segment includes a pivotally mounted footrest panel that extends into a substantially horizontal position when said cot is in said chair position and retracts into a substantially flush position with said leg segment when said cot is in said fully-reclined position.

15. A combination ambulance cot and chair as claimed in claim 1, wherein said segmented patient support further comprises a leg segment pivotably attached to said support frame and said seat segment, wherein said leg segment includes a pivotally mounted footrest that is movable between a retracted position that is substantially flush with said leg segment and an elevated position which places said leg segment above said retracted position.

16. A combination ambulance cot and chair as claimed in claim 1, wherein said segmented patient support further comprises a leg segment pivotably attached to said seat segment, wherein said securing device provides a pin and a pivot member having a plurality of pin catches each sized to accommodate at least a portion of said pin, wherein said seat segment is fixed to said pivot member, whereby when said pin is accommodated in a first one of said pin catches, said combination ambulance cot and chair is releasably secured in the fully-reclined position, and when accommodated in a second one of said pin catches, said combination ambulance cot and chair is releasably secured in the chair position.

17. A combination ambulance cot and chair, comprising:

a support frame comprising a pair of upper frame members, a lower frame member, and a pair of side arm members pivotally connected at one end to the upper frame member and to the lower frame member adjacent to the other end, said support frame having a pair of brackets and a pair of linkages, each of said pair of brackets comprising at least one one-piece member, said pair of brackets mounted to said pair of upper frame members;

a segmented patient support pivotally mounted to said support frame for movement at least between a chair position and a fully-reclined position, said segmented patient support having a seat segment, a back segment pivotally attached to said support frame, and a leg segment pivotably attached to said seat segment, said pair of side arm members pivotally connected to said pair of brackets at a first position on said one-piece member, said seat segment having a side support wherein a proximate end of said side support is pivotally connected to said pair of brackets at a second position on said one-piece member, and wherein a proximate end of said pair of linkages is pivotally connected to said pair of brackets at a third position on said one-piece member and a distal end of said pair of linkages is pivotally connected to said lower frame member, and wherein said upper frame members are pivotally connected to said pair of brackets at said first position and said second position, and wherein said second position is intermediate said first position and said third position, and wherein when said pair of upper frame members are moved from a chair position to a reclined position, said pair of brackets push said pair of linkages lifting said lower frame member;

a securing device provided to one of said pair of brackets, said securing device having a pivot member fixed to a proximate end of said side support of said seat segment, said pivot member being releasably locatable in at least the fully-reclined position by a remote actuator, wherein said securing device and support frame provide a pin guide-fixed pin arrangement;

a wheeled base; and legs each having a first end pivotably attached to said support frame and a second end attached to said wheeled base, said combination cot and chair is selectively positionable in either a raised position which situates said legs substantially perpendicular to said seat segment, and a lowered position which situates at least two of said legs folded adjacent said seat segment.

18. A combination ambulance cot and chair, comprising:

a support frame comprising a pair of upper frame members, a lower frame member, and a pair of side arm members pivotally connected at one end to the upper frame member and to the lower frame member adjacent to the other end, said support frame having a pair of brackets and a pair of linkages, each of said pair of brackets comprising at least one one-piece member, said pair of brackets mounted to said pair of upper frame members;

a segmented patient support pivotally mounted to said support frame for movement at least between a chair position and a fully-reclined position, said segmented patient support having a seat segment, a leg segment pivotably attached to said seat segment, and a back segment pivotably attached to said support frame, said pair of side arm members pivotally connected to said pair of brackets at a first position on said one-piece member, said seat segment having a side support wherein a proximate end of said side support is pivotally connected to said pair of brackets at a second position on said one-piece member, and wherein a proximate end of said pair of linkages is pivotally connected to said pair of brackets at a third position on said one-piece member and a distal end of said pair of linkages is pivotally connected to said lower frame member, and wherein said upper frame members are pivotally connected to said pair of brackets at said first position and said second position, and wherein said second position is intermediate said first position and said third position, and wherein when said pair of upper frame members are moved from a chair position to a reclined position, said pair of brackets push said pair of linkages lifting said lower frame member;

a securing device provided to one to said pair of brackets, said securing device having a pin and a pivot member providing a plurality of pin catches each sized to accommodate at least a portion of said pin, a proximate end of said side support of said seat segment is fixed to said pivot member, and said pin is movably between said catches by a remote actuator, whereby when said pin is accommodated in a first one of said pin catches, said combination ambulance cot and chair is releasably secured in the fully-reclined position, and when said pin is accommodated in a second one of said pin catches, said combination ambulance cot and chair is releasably secured in the chair position, wherein said securing device and support frame provide a pin guide-fixed pin arrangement;

a wheeled base; and legs each having a first end pivotably attached to said support frame and a second end attached to said wheeled base, said combination cot and chair is selectively positionable in either a raised position which situates said legs substantially perpendicular to said seat segment, and a lowered position which situates at least two of said legs folded adjacent said seat segment.

19. A combination ambulance cot and chair as claimed in claim 17, wherein said pair of brackets mounting a cross-member therebetween at said first position, and wherein two legs are pivotably attached to a respective one of said side arm members, and two legs are pivotably attached to said cross-member.

20. A combination ambulance cot and chair as claimed in claim 18, wherein said pair of brackets mounting a cross-member therebetween at said first position, and wherein said first end of two legs is pivotably attached to a respective one of said side arm members, and two legs are pivotably attached to said cross-member.

* * * * *